US005715848A

United States Patent [19]

Conley, Jr.

[11] Patent Number: 5,715,848

[45] Date of Patent: Feb. 10, 1998

[54] LIPSTICK HOLDER SYSTEM

[76] Inventor: Ralph F. Conley, Jr., c/o Direct Business Technologies, Inc., 204 S. Third St., Miamisburg, Ohio 45342

[21] Appl. No.: 646,508

[22] Filed: May 7, 1996

[51] Int. Cl.[6] ..... A45D 33/28

[52] U.S. Cl. ..... 132/297; 132/303; 132/304

[58] Field of Search ..... 132/293, 294, 132/297, 300, 301, 304, 314, 318, 303

[56] References Cited

U.S. PATENT DOCUMENTS

| | | | |
|---|---|---|---|
| D. 337,860 | 7/1993 | Ryder | D28/77 |
| 1,626,311 | 4/1927 | Tipton . | |
| 2,209,789 | 7/1940 | Mureau | 88/97 |
| 2,452,131 | 10/1948 | Kruck | 15/130.1 |
| 2,491,101 | 12/1949 | Freiberg | 132/297 |
| 2,512,476 | 6/1950 | Birnkrant et al. . | |
| 2,522,403 | 9/1950 | Ross . | |
| 2,552,714 | 5/1951 | Gardiner | 15/131 |
| 2,619,096 | 11/1952 | Kuhnl . | |
| 2,653,339 | 9/1953 | Mureau | 15/131 |
| 2,665,696 | 1/1954 | Weis | 132/318 |
| 2,796,874 | 6/1957 | Steiner | 132/300 |
| 3,306,266 | 2/1967 | McCunney | 120/1 |
| 3,809,102 | 5/1974 | Ross | 132/297 |
| 3,949,511 | 4/1976 | Goldhaft | 43/20 |
| 4,555,020 | 11/1985 | Campello et al. | 132/294 |
| 4,562,923 | 1/1986 | Katada et al. | 132/314 |
| 5,067,836 | 11/1991 | Khan | 401/52 |
| 5,178,478 | 1/1993 | Ryder | 401/195 |
| 5,226,541 | 7/1993 | Huang | 132/294 |
| 5,301,808 | 4/1994 | Pierson | 132/297 |
| 5,320,125 | 6/1994 | Barnart | 132/297 |
| 5,441,153 | 8/1995 | Lahaye | 206/581 |

FOREIGN PATENT DOCUMENTS

| | | | |
|---|---|---|---|
| 609784 | 10/1948 | United Kingdom | 132/297 |

*Primary Examiner*—Todd E. Manahan

*Attorney, Agent, or Firm*—Jacox, Meckstroth & Jenkins

[57] ABSTRACT

A cosmetic system and method is disclosed as comprising a housing having a plurality of apertures for receiving a plurality of cosmetic items, such as lipstick, eye liners, brushes, powders and the like, in one organized and portable holder. The cosmetic system further includes a sharpener for sharpening one or more of the cosmetic tools, such as the pencils/liners and a flip-open mirror for use when applying the cosmetics. The cosmetics and cosmetic tools, mirrors, sharpener and the like are all provided in one convenient storage receptacle or housing which is compact, portable and easily stored in a small area, such as in a purse, travel bag, suitcase, drawer or the like.

38 Claims, 2 Drawing Sheets

L
H
W
10
12
22
24
26
28
32
34
36
40
42
44
43

14
16
18
20
30
30a
30b
30c
46
38

LIPSTICK HOLDER SYSTEM

BACKGROUND OF THE INVENTION

1. Field of the Invention

This invention relates to a lipstick holder and, more particularly, to a cosmetic system and method for providing a hand-held, self-contained, portable cosmetic organizing and storage device and method for organizing and storing various cosmetics.

2. Description of Related Art

In the past, it was not uncommon to provide lipstick holders for housing a lipstick which are portable and can be stored in, for example, a purse. Typically, separate cosmetic items such as a mascara brush, a lip liner, an eye liner, powder brush and the like were also separately stored in a small place.

When such items were used, a user typically found herself rummaging through her purse trying to locate the various cosmetics. Even after one or more of the items were located, it was not uncommon that the various liners, pencils and the like needed to be sharpened, yet there were no convenient means associated with the liners/pencils to sharpen them (for example, at home, school, work, or during travel and the like).

What is need, therefore, is a system and method which conveniently organizes and stores and various cosmetic items in a single location and in a manner which permits the items to be situated in a single place which did not consume a lot of space.

SUMMARY OF THE INVENTION

Accordingly, a primary object of this invention is to provide a system and method for organizing and storing a plurality of cosmetics and cosmetic tools in a single housing which does not consume a lot of space.

Another object of this invention is to provide means for sharpening cosmetic liners and pencils by providing sharpening means associated with the housing which also provides storage for a plurality of cosmetic items.

Another object of this invention is to provide a convenient system and method for interchanging cosmetics such that each user may customize his or her own cosmetic kit by selecting the cosmetic items he or she wishes to carry.

Still another object of the invention is to provide a multi-purpose cosmetic system which provides a mirror, housing for various cosmetic items (including lipstick, lip liners, eye liners, brushes, and powders) in one convenient location which consumes only a small area in a purse, briefcase, travel bag, drawer or the like.

In one aspect, this invention comprises a cosmetic system consisting of a housing defining a plurality of apertures for receiving a plurality of cosmetic items.

In another aspect this invention comprises a portable make-up kit consisting of a lipstick holder for holding lipstick and a plurality of elongated cosmetic items, the holder comprising a plurality of apertures, at least one of the plurality of apertures being capable of receiving at least one of the plurality of elongated cosmetic items.

In still another aspect this invention comprises a lipstick holder for removably holding a lipstick, said lipstick holder consisting of a first aperture for removably holding at least one cosmetic item; said at least one cosmetic item comprising a generally elongated cosmetic tool.

In yet another aspect this invention comprises, a method for organizing a plurality of cosmetic items consisting of the steps of providing a hand-held lipstick holder for receiving a lipstick, the hand-held lipstick holder also comprising at least one cosmetic receiving area for receiving at least one cosmetic item, situating said lipstick in said hand-held lipstick holder, and situating the at least one cosmetic item in the at least one cosmetic receiving area.

In still another object this invention comprises a method for applying make-up comprising the steps of removing a lipstick from a lipstick holder, applying said lipstick to a pair of lips, removing a cosmetic tool from the same said lipstick holder, and using the cosmetic tool.

The above and other objects, features, and advantages of the present invention will become apparent from the following description and attached drawings.

BRIEF DESCRIPTION OF THE ACCOMPANYING DRAWINGS

DESCRIPTION OF PREFERRED EMBODIMENT

Figures 1, 2:
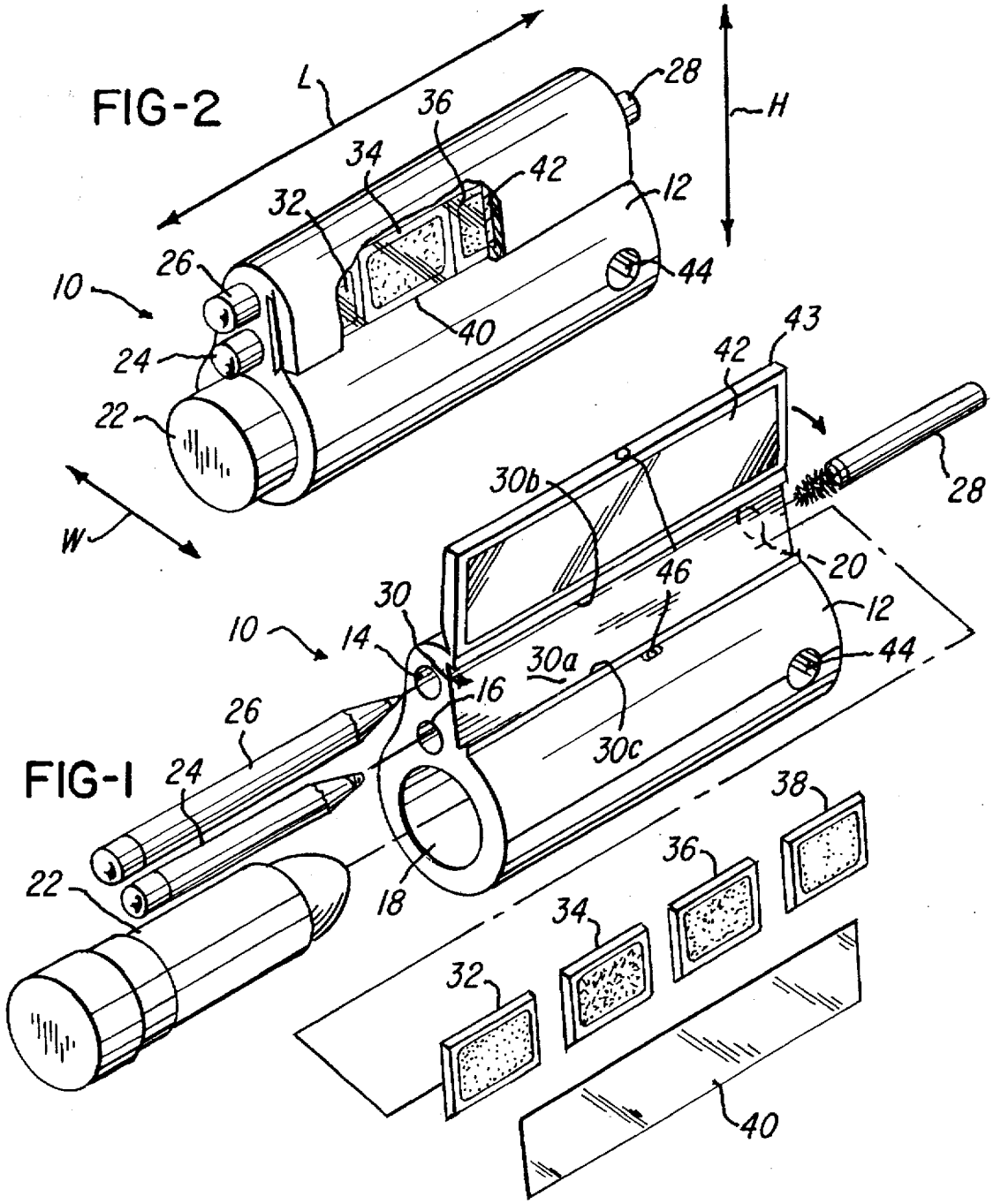
FIG. 1 is an exploded view of the cosmetic system having a plurality of interchangeable and user selective cosmetics.
FIG. 2 is a view of the system illustrated in FIG. 1 showing a mirror in a closed position, with the selected cosmetics in a stored or organized position.

Referring now to FIG. 1, a cosmetic system 10 is shown comprising a housing 12 comprising a plurality of apertures 14, 16, 18 and 20 for receiving a plurality of cosmetic items.

In the embodiment being described, the plurality of cosmetic items may comprise a lipstick 22, an eye liner 24, a lip liner 26, a mascara brush 28, a eyeshadow brush (not shown) or any other suitable cosmetic item or tool.

It should be appreciated that the plurality of apertures 14, 16, 18 and 20 are generally cylindrical and elongated and suitable for snugly receiving at least one of the cosmetic items 26, 24, 22 and 20, respectively, until they are conveniently stored in an organized and stored travel position, as illustrated in FIG. 2.

The cosmetic system 10 further comprises a generally rectangular elongated slot 30 defined by a bottom surface 30*a* and side surfaces 30*b* and 30*c*. Notice that the side surfaces 30*b* and 30*c* are somewhat beveled in order to receive at least one of a plurality of cosmetics, such as cosmetic powders 32, 34, 36 and 38. In the embodiment being described, the cosmetics 32, 34, 36 and 38 each comprise a case which is easily inserted into slot 30 and may each comprise one or more cosmetics, such as eyeshadow powder, lip gloss, VASELINE® or other suitable cosmetics, such as a cosmetic application pad (not shown).

Further, the cosmetic system 10 may further comprise a plastic, glass or other suitable transparent cover 40 which is slidably mounted over cosmetics 32, 34, 36 and 38 after they are placed in slot 30.

Notice that the cosmetic system 10 further comprises a mirror 42 which is hingably mounted to housing 12 as illustrated in FIG. 1, such that the mirror 42 can be actuated from the open position illustrated in FIG. 1 to a closed position (FIG. 2).

In the embodiment being described, the aperture 20 is suitable for receiving mascara and a mascara brush situated or stored therein such that the mascara brush 28 becomes "loaded" when it is situated in aperture 20.

As further illustrated in FIGS. 1 and 2, the cosmetic system 10 comprises sharpening means or a sharpener 44 for sharpening one or more of the cosmetic items, such as eye liner 24 and lip liner 26. Notice that when the transparent cover 40 is situated in aperture 30 over cosmetics 32, 34, 36 and 38, these cosmetics become covered. Thus, when the mirror 42 is moved to the closed position illustrated in FIG. 2, the cover 40 protects the mirror 42 from receiving or being covered with unwanted powder or other debris.

It should be appreciated that the cosmetic system of the present invention occupies a volume of less than twelve cubic inches in the embodiment being described. In this regard, the cosmetic system may comprise a length L (FIG. 2) of less than 4", a height H of less than 2" and a width W of less than 1½".

Advantageously, the cosmetic system of the present invention provides a convenient cosmetic kit for organizing and storing a plurality of cosmetic items, including the lipstick 22, mirror 42 and sharpener 44 for sharpening. The cosmetic system 10 is convenient in that it fits in a relatively small space, such as a purse, brief case or small drawer and provides a small yet convenient portable system and method for storing a plurality of cosmetic items which are commonly used by women daily at home, during work or while traveling. The system and method also provide means for conveniently selectively organizing the plurality of cosmetic items into a predetermined order and for applying makeup as will now be described.

Notice also that the cosmetic system 10 further comprises a latch 46 for locking the mirror 42 in the closed position illustrated in FIG. 2.

Figure 3:
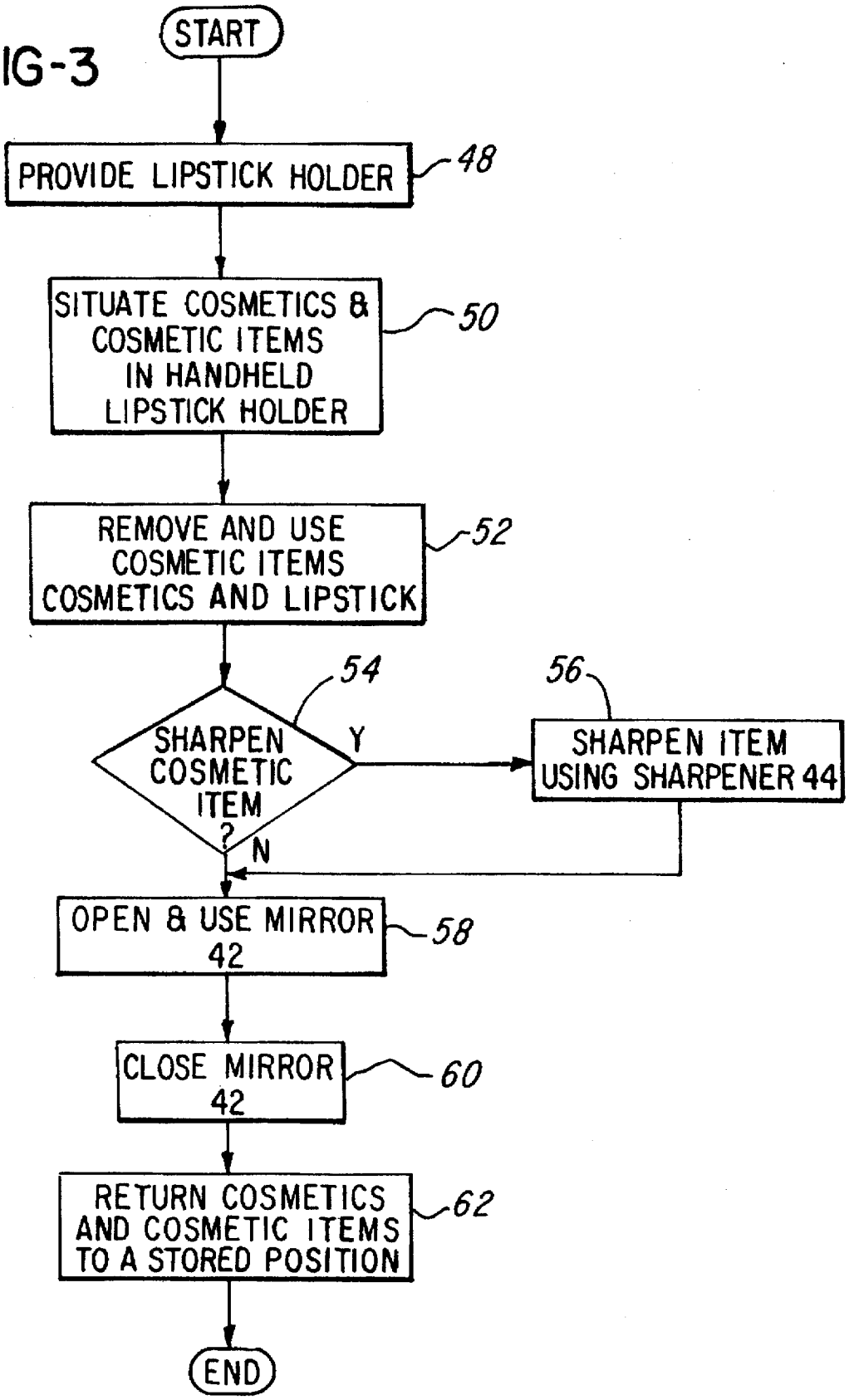
FIG. 3 is a schematic showing a general method or procedure for utilizing the system of the present invention.

The method begins by providing a hand-held lipstick housing 12 (block 48) in FIG. 3. At block 50, the lipstick 22, as well as one or more of the cosmetic items 24, 26, 28 or cosmetics 32, 34, 36 and/or 38, are also selected and situated in the handheld lipstick housing 12. Further, it should be appreciated that the sharpener 44 is positioned in the hand-held lipstick housing 12 and the mirror 42 is situated on the lid 43.

Once the cosmetics and cosmetic items are situated in or on the housing 12 as illustrated, the cosmetic system 10 may be used by removing one or more of the items (such as lipstick 22) from housing 12 and using the cosmetic and cosmetic items in a conventional manner (block 52). If one or more of the cosmetic tools or cosmetic items, such as items 24 and 26 need sharpening either prior to, during, or after their use (decision block 54), then they may be sharpened (block 56).

The method then proceeds to block 58. At any time during the cosmetic application procedure, it may be desired to open and use mirror 42 to facilitate the application and use of the cosmetic items 22, 24, 26 and 28 and cosmetics 32, 34, 36 and 38. Thereafter, the mirror 42 may be closed (block 60) and the cosmetic items returned to a stored position, as illustrated in FIG. 2 (block 62) in FIG. 3.

The cosmetic system 10 may then be returned or stored conveniently in a confined area, such as a purse, briefcase, suitcase, traveling bag or other suitable storage area.

It should be appreciated that the cosmetics 32, 34, 36, and 38 may be interchanged and/or replaced and individually selected by a user. Likewise, the lipstick 22, liners 24 and 26 and mascara brush 28 are replaceable, interchangeable or selected as deemed fit by the user. This unique feature enables a user to customize its portable, hand-held lipstick holder to carry only those cosmetics, cosmetic items and cosmetic tools that she may choose.

This system and method further comprises the advantage of providing a plurality of cosmetic, cosmetic items and tools in an organized and stored manner such that their location, use and reuse is easy and convenient, for example, in the dark.

While it is contemplated that the housing 12 be manufactured from a disposable material, it should be appreciated that it is contemplated that it could be reused, for example, with new or different cosmetics as may be desired by the user. Although not shown, the cosmetic system 10 could be provided with greater or fewer apertures for receiving more or fewer, respectively cosmetics. Also, the system could be provided with a battery-operated night light (not shown) which illuminates, for example, when the lid 43 is in the open position.

While the methods herein described, and the forms of apparatus for carrying these methods into effect constitute preferred embodiments of this invention, it is to be understood that the invention is not limited to these precise methods and forms of apparatus, and that changes may be made either without departing from the scope of the invention which is defined in the appended claims.

I claim:

1. A cosmetic system consisting essentially of:

a one piece integral housing; said one piece integral housing comprising a plurality of apertures for receiving a plurality of cosmetic items;

at least two of said plurality of apertures defining different dimensions in cross-section; and at least two cosmetic items for press-fitting into said at least two of said plurality of apertures, respectively.

2. The cosmetic system as recited in claim 1 wherein said plurality of cosmetic items comprise:

a lipstick and a cosmetic utensil.

3. The cosmetic system as recited in claim 2 wherein said cosmetic utensil is an eye liner.

4. The cosmetic system as recited in claim 2 wherein said cosmetic utensil is a mascara brush.

5. The cosmetic system as recited in claim 2 wherein said cosmetic utensil is a lip liner.

6. The cosmetic system as recited in claim 1 wherein said plurality of cosmetic items comprises at least two items selected from the group comprising: a lipstick, a lip liner, a mascara brush, an eye liner, or a powder.

7. The cosmetic system as recited in claim 1 wherein said system further comprises at least one tray for receiving a cosmetic.

8. The cosmetic system as recited in claim 7 wherein said cosmetic is a powder.

9. The cosmetic system as recited in claim 1 wherein said system further comprises:

a sharpener for sharpening at least one of said plurality of cosmetic items.

10. The cosmetic system as recited in claim 1 wherein said housing comprises a mirror secured thereto.

11. The cosmetic system as recited in claim 1 wherein said housing further comprises a mirror hingeably secured thereto such that when said mirror is moved to a closed position, at least one of said cosmetic items is concealed.

12. The cosmetic system as recited in claim 1 wherein said at least two of said plurality of apertures comprises:

a first aperture for receiving a lipstick;

a second aperture for receiving a liner.

13. The cosmetic system as recited in claim 1 wherein said housing comprises:

a least one aperture for receiving at least one powder.

14. The cosmetic system as recited in claim 13 wherein said system further comprises a cover for covering said at least one powder.

15. The cosmetic system as recited in claim 13 wherein said housing comprises:

a least one aperture for receiving at least one powder.

16. The cosmetic system as recited in claim 15 wherein said system further comprises a cover for covering said at least one powder.

17. A portable make-up kit consists essentially of:

a lipstick holder for holding lipstick and a plurality of elongated cosmetic items;

said lipstick holder comprising a one-piece integral housing;

said one-piece integral housing defining a lipstick aperture and a plurality of apertures;

a lipstick for receipt in said lipstick aperture; and a plurality of cosmetics which may be press-fit into said plurality of apertures, respectively.

18. The portable make-up kit as recited in claim 17 wherein said holder occupies an volume of less than twelve cubic inches.

19. The portable make-up kit as recited in claim 17 wherein said plurality of apertures are generally cylindrically in shape and are dimensioned to securingly receive at least one of said plurality of elongated cosmetic items.

20. The portable make-up kit as recited in claim 19 wherein at least one of said plurality of apertures is capable of receiving a powder and a second one of said plurality of apertures is suitable for receiving at least one of said elongated cosmetic items.

21. The portable make-up kit as recited in claim 17 wherein said holder comprises a sharpener for sharpening at least one of said plurality of cosmetic items.

22. The portable make-up kit as recited in claim 17 wherein said holder comprises a mirror secured thereto.

23. The portable make-up kit as recited in claim 17 wherein said holder comprises a mirror hingeably secured to said holder.

24. The portable make-up kit as recited in claim 17 wherein said kit comprises a plurality of make-up trays; at least one of a plurality of said holders being suitable for receiving and holding said plurality of make-up trays.

25. The portable make-up kit as recited in claim 24 wherein said plurality of make-up trays are interchangeable.

26. The portable make-up kit as recited in claim 24 wherein said holder comprises a mirror which can be moved from an open position to a closed position such that when said mirror is in said closed position said plurality of make-up trays are concealed.

27. The portable make-up kit as recited in claim 17 wherein said plurality of make-up items comprise at least one item selected from the group consisting essentially of: a lip liner, an eye liner, a mascara brush, or a powder brush.

28. A lipstick holder for removably holding lipstick, said lipstick holder consists essentially of:

a one-piece integral housing defining a plurality of apertures;

at least two of said plurality of apertures defining different dimensions in cross-section; and a plurality of cosmetic items for press-fitting into said plurality of apertures.

29. The lipstick holder as recited in claim 28 wherein said generally elongated cosmetic tool comprises either a lip liner, an eye liner, a mascara brush or an eye shadow brush.

30. The lipstick holder as recited in claim 28 wherein said lipstick holder further comprises:

a second aperture for receiving a second cosmetic item.

31. The lipstick holder as recited in claim 30 wherein said at least one first and second cosmetic items are selected from a group comprising a lip liner, an eye liner, a powder brush or a mascara brush.

32. The lipstick holder as recited in claim 31 wherein said lipstick holder comprises a sharpener for sharpening at least one of said at least one first and second cosmetic items.

33. The lipstick holder as recited in claim 28 wherein said lipstick holder comprises a sharpener for sharpening said at least one first cosmetic item.

34. The lipstick holder as recited in claim 28 wherein said holder comprises a storage area for storing at least one cosmetic supply.

35. The lipstick holder as recited in claim 34 wherein said at least one cosmetic supply comprises a powder.

36. The lipstick holder as recited in claim 34 wherein said at least one cosmetic supply comprises a gel.

37. The lipstick holder as recited in claim 28 wherein said lipstick holder further comprises a mirror hingeably secured to said lipstick holder.

38. The lipstick holder as recited in claim 28 wherein said lipstick holder further comprises a mirror hingeably secured to said lipstick holder such that, when said mirror is actuated to a closed position, said at least one cosmetic supply becomes covered.

* * * * *